US006745518B2

(12) United States Patent
Weakes et al.

(10) Patent No.: US 6,745,518 B2
(45) Date of Patent: Jun. 8, 2004

(54) AIR VENT DEFLECTOR INSERT

(76) Inventors: Jeffrey L. Weakes, 6614 Robins Ct., Ypsilanti, MI (US) 48197; Edward S. Jacobs, 248 Spink, Milan, MI (US) 48160

( * ) Notice: Subject to any disclaimer, the term of this patent is extended or adjusted under 35 U.S.C. 154(b) by 28 days.

(21) Appl. No.: 10/202,198

(22) Filed: Jul. 24, 2002

(65) Prior Publication Data

US 2003/0019164 A1 Jan. 30, 2003

Related U.S. Application Data

(60) Provisional application No. 60/307,526, filed on Jul. 24, 2001.

(51) Int. Cl.[7] ..... E04B 7/00

(52) U.S. Cl. ..... 52/22; 52/200; 454/299

(58) Field of Search ..... 52/22, 200, 171.3, 52/732.1, 198, 218, 219; 98/40.05; 454/299, 300

(56) References Cited

U.S. PATENT DOCUMENTS

| | | | | |
|---|---|---|---|---|
| 456,520 | A | | 7/1891 | Reese |
| 1,571,631 | A | | 2/1926 | Krueger |
| 1,624,225 | A | | 4/1927 | Elters |
| 1,703,567 | A | | 2/1929 | Behringer |
| 2,080,726 | A | | 5/1937 | Lowinger |
| 3,386,367 | A | | 6/1968 | Pellegrino |
| 3,502,016 | A | | 3/1970 | Steele |
| 4,481,871 | A | | 11/1984 | Efstratis |
| 4,602,556 | A | | 7/1986 | Gladden |
| 4,655,120 | A | * | 4/1987 | Lemmo |
| 4,686,890 | A | * | 8/1987 | Stouffer et al. ..... 454/155 |
| 5,016,406 | A | * | 5/1991 | Calam et al. ..... 52/58 |
| D334,801 | S | * | 4/1993 | McConnell |
| 5,292,282 | A | * | 3/1994 | Callas |
| D387,155 | S | * | 12/1997 | Callas |
| 6,010,402 | A | * | 1/2000 | Schmidt |
| 6,067,759 | A | * | 5/2000 | House ..... 52/198 |
| 6,604,329 | B2 | * | 8/2003 | Hoy et al. ..... 52/200 |

* cited by examiner

*Primary Examiner*—Carl D. Friedman
*Assistant Examiner*—Chi Q. Nguyen
(74) *Attorney, Agent, or Firm*—Gifford, Krass, Groh, Sprinkle, Anderson & Citkowski, PC

(57) ABSTRACT

An air deflector is designed for use with an air vent supported in a suspended ceiling grid. The air deflector includes a deflector body with four side members, each having a pair of opposed ends and a mid-portion therebetween. At least two of the side members further include a support tab extending outwardly from the upper edge of the downwardly extending wall segment. The deflector body is formed from a resilient material such that the deflector may be deformed into a non-rectangular shape and the support tabs may be positioned between the upper surface of the grid members defining the rectangular opening and the lower surface of the perimeter edge of the air vent, without disassembling the deflector body or removing the air vent from the rectangular opening.

20 Claims, 3 Drawing Sheets

AIR VENT DEFLECTOR INSERT

REFERENCE TO RELATED APPLICATIONS

This application claims priority to U.S. provisional patent application Serial No. 60/307,526, filed Jul. 24, 2001, the entire contents of each application being incorporated herein by reference.

FIELD OF THE INVENTION

The present invention relates generally to air vents and, more specifically, to a deflector insert for use with generally rectangular air vents supported in suspended ceiling grids.

In commercial and industrial buildings, the ceiling of rooms is often defined by a suspended ceiling, including a grid work of perpendicular grid members and ceiling tiles supported by the grid work. The perpendicular grid members define panel openings that typically have a dimension of 2 foot×2 foot, or 2 foot×4 foot. A variety of different ceiling tile types and designs may be supported in these panel openings so as to define a generally continuous, flat ceiling surface. Luminaires or light panels may also be supported in the panel openings in place of some of the ceiling tiles. Air vents may also be provided in the ceiling grid for the supply and return of heated or cooled air to the building's climate control system. These air vents are typically a standard size, such as 2 foot×2 foot, to fit in one of the panel openings, in place of a ceiling tile. The air vents have a vent face with a plurality of air passage openings through which air flows.

Even though climate control systems typically include air filtration, the air flow into and out of air vents in the ceiling grid usually has some dirt, dust, or debris particles suspended in the air flow. A problem with typical air vent installations is that these particles will accumulate on the grid members and/or edges of ceiling tiles surrounding an air vent, leading to a soiled appearance. For example, in an air vent that is suspended in a generally horizontal ceiling, the air vent is often designed to direct the air flow horizontally close to the ceiling or to draw air from horizontally along the ceiling. Therefore, air flow passing into and out of an air vent flows along the edges of the surrounding ceiling tiles and grid members, and particles suspended in the air flow may accumulate around the air vent. Cleaning of the soiled grid members and surrounding tiles is difficult and time consuming. However, leaving the surrounding materials in the soiled condition is highly undesirable for some facilities.

In order to reduce the amount of debris accumulating on the grid members and ceiling tiles surrounding an air vent, there have been some attempts to provide air deflectors that direct the air flow away from the surrounding members. For example, a downwardly extending flange may be welded to an air vent, prior to installation, so as to direct air flow downwardly away from the vent and away from the surrounding materials. Such an approach is expensive and time consuming. Also, it is very difficult to retrofit a welded-on deflector to an already installed air vent.

Another approach to providing an air deflector is shown in U.S. Pat. Nos. 5,292,282 and D387,155 to Callas. This design provides elongated baffles that have a magnetic strip on their upper edge. One baffle may be attached to the ceiling grid member on each side of an air vent, using the magnetic strip. Strips may be provided on some or all of the sides, as needed. While this design is easier to use than a welded flange, it remains costly, requires the grid members to be made of a ferromagnetic material, and has an appearance that may not be acceptable in some applications.

U.S. Pat. No. 4,655,120 to Lemmo provides a deflector skirt which is assembled from four elongated deflector plates. The deflector plates may be assembled together around the air vent, and preferably welded together. As with a welded flange, this design is laborious to use and would present difficulties in removing the deflector skirt for cleaning or when its use is not desirable.

U.S. Pat. No. 3,502,016 to Steele provides a deflector skirt similar to the Lemmo design, but adapted to be adjustable in length and width and to be attached to a wall vent. For this purpose, it is provided with fasteners which pass through the deflector skirt and engage in the wall. This design is not suitable for use with a typical suspended ceiling.

U.S. Pat. No. 3,386,367 to Pellegrino provides an anti-smudge ring designed to prevent the accumulation of dirt around a circular air duct in a ceiling. It consists of a round flange that is attached to the ceiling around the air duct and turns back in on itself to form a dust trap. This ring appears to require being designed into the original vent and is not suitable for use with a typical suspended ceiling grid.

There have also been numerous attempts to provide deflectors of various types for wall and floor mount vents. These deflectors are typically provided to direct the air flow more into the central portion of the room or to deflect air flow away from curtains or furniture. Examples of these deflectors are shown in the following patents: U.S. Pat. No. 456,520 to Reese, U.S. Pat. No. 1,571,631 to Krueger, U.S. Pat. No. 1,624,225 to Elters, U.S. Pat. No. 1,703,567 to Behringer, U.S. Pat. No. 2,080,726 to Lowinger, U.S. Pat. No. 3,665,969 to Clifford, and U.S. Pat. No. 4,602,556 to Gladden. While these designs are suitable for use in their intended application, none are suitable for use with a suspended ceiling grid.

SUMMARY OF THE INVENTION

The present invention overcomes many of the shortcomings of the prior art by providing an air vent deflector insert that may be positioned adjacent an air vent that is already installed in a suspended ceiling grid. It is for use with a ceiling grid of the type having a plurality of grid members intersecting so as to form a generally rectangular opening. The opening may be said to have a predetermined length and a predetermined width. Each of the grid members forming the opening has an upper surface for supporting the air vent. The air vent has a generally rectangular perimeter edge with a lower surface that rests on the upper surfaces of the grid members defining the generally rectangular opening. The air deflector has a deflector body with four side members. Each of the side members has a pair of opposed ends and a mid-portion therebetween. The ends of each side member are joined to an end of another side member such that the four members form a generally rectangular assembly. Each side member includes a downwardly extending wall segment having a lower edge and an upper edge. The upper edges of the wall segments together define a rectangular perimeter with a length approximately equal to the predetermined length of the rectangular opening and a width approximately equal to the predetermined width of the rectangular opening. At least two of the side members further include a support tab extending outwardly from the upper edge of the downwardly extending wall segment. The supports tabs are designed to be received between the upper surfaces of the grid members defined in the rectangular opening and the lower surface of the perimeter edge of the air vent such that the deflector body is retained adjacent the rectangular opening. The deflector body is formed of a resilient material such that the deflector body may be deformed into a non-rectangular shape and the support tabs may be positioned between the upper surfaces of the grid members defining the rectangular opening and the lower surface of the perimeter edge of the air vent without disassembling the deflector body or removing the air vent from the rectangular opening.

In some versions of the present invention, support tabs extend from the upper edge of each of the wall segments and consist of continuous flange with a length less than the wall segment. The continuous flange does not extend to the corners of the rectangular member. Preferably, the deflector body is unitarily formed of a flexible and resilient material and does not require any assembly. The present invention also provides a method for installing an air deflector according to the present invention adjacent an air vent that has already been installed in a ceiling grid.

DETAILED DESCRIPTION OF THE PREFERRED EMBODIMENTS

Figure 1:
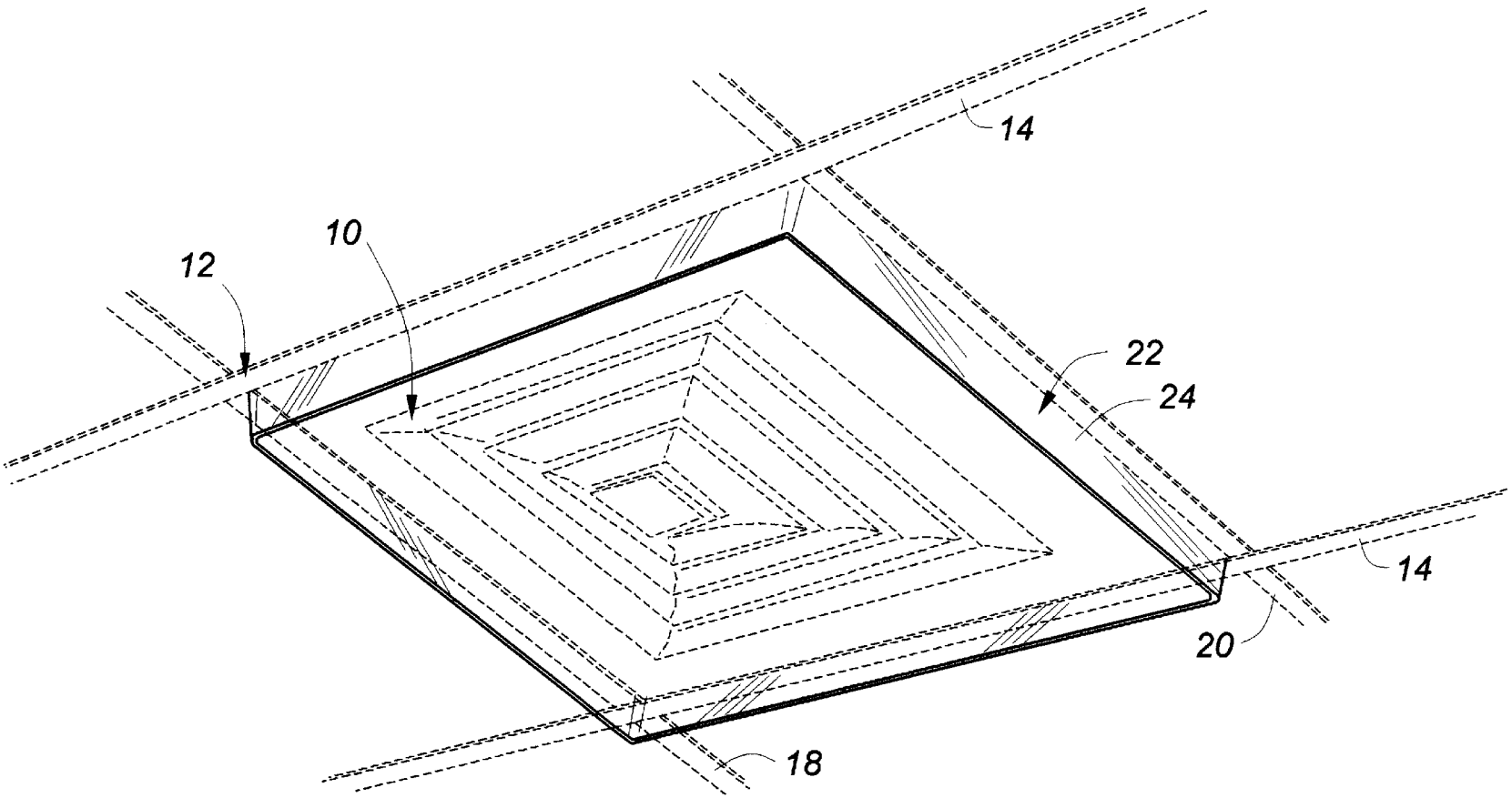
FIG. 1 is a perspective view of a portion of a suspended ceiling grid with an air vent supported therein, and an air deflector according to the present invention attached to the ceiling grid.

Referring now to FIG. 1, an air vent 10 is shown supported in a ceiling grid 12 consisting of parallel grid members 14 and 16 and perpendicular grid members 18 and 20. The grid members 14–20 together define a generally rectangular opening into which the air vent 10 has been placed. Typically, the grid members are spaced apart at approximately 2 foot or 4 foot on center. Depending on the arrangement of the ceiling grid members, the generally rectangular openings may be approximately 2 foot×4 foot or 2 foot×2 foot. An opening for an air vent is typically approximately 2 foot×2 foot. However, the grid members have a width, which reduces the actual length and width of an air vent opening to approximately 23–23.25 inches. The air vent itself has a length and width somewhat larger than the opening so that the edges of the air vent rest on the grid members.

As shown, the air vent 10 has a plurality of air openings which deflect air outwardly from the center of the vent. A deflector 22 according to the present invention is shown installed so as to provide a downwardly extending wall segments 24 surrounding the perimeter of the air vent 10. There are several embodiments of the deflector according to the present invention. In one preferred embodiment, the wall segments are continuous with one another and formed of plastic, which may be either clear or colored.

Figure 2:
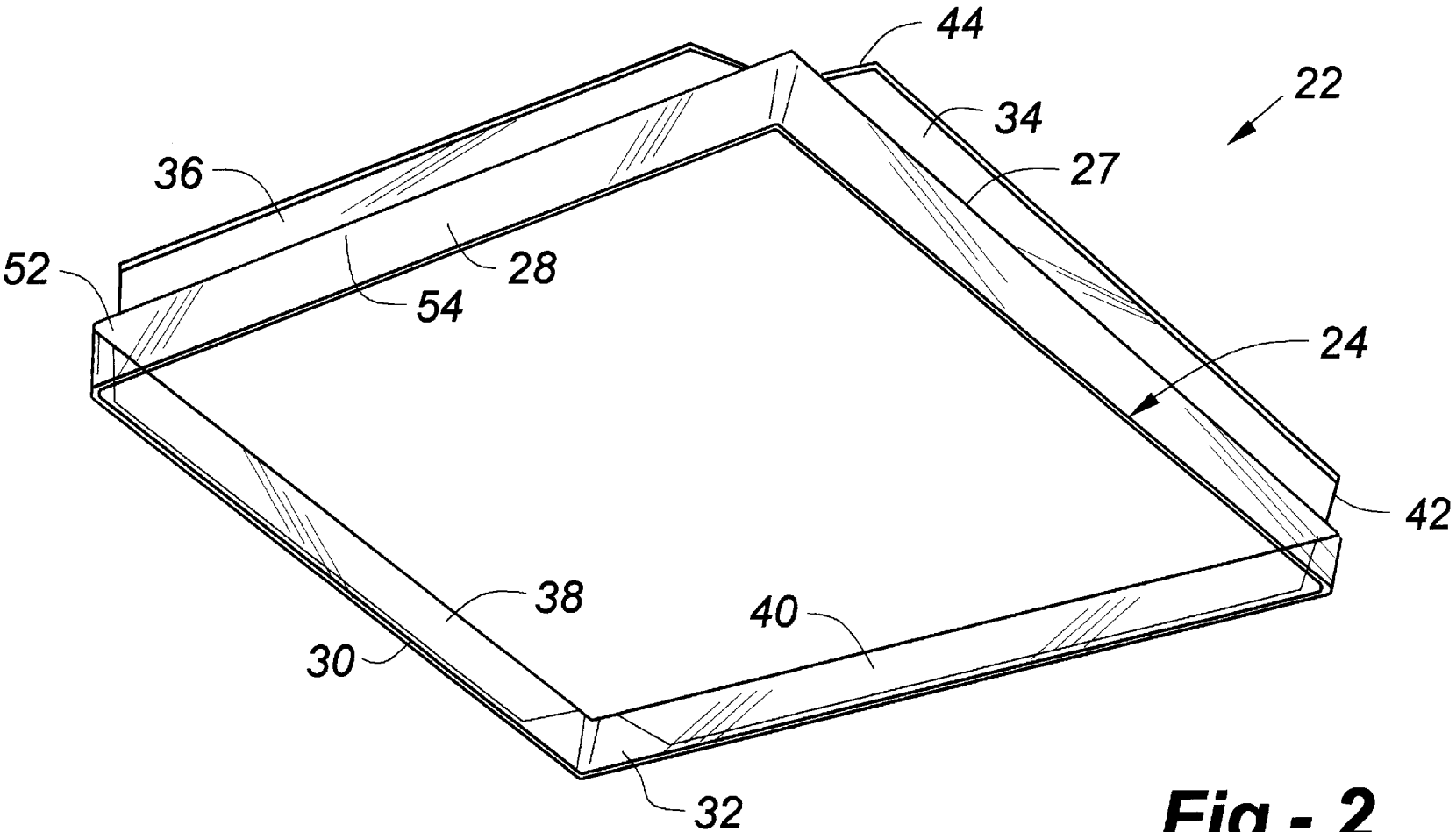
FIG. 2 is a perspective view of a first embodiment of an air deflector according to the present invention.

Referring now to FIG. 2, one version of the deflector 22 is shown prior to installation. It includes the downwardly extending wall segments 24. Because the deflector is designed for a square air vent, it may be said to have four side members, each of which comprises a downwardly extending wall segments 26, 28, 30, and 32. Using wall segment 26 as an example, each of the wall segments may be said to have a lower edge 25 and an upper edge 27. Support tabs 34, 36, 38, and 40 extend perpendicularly outwardly from the upper edge of each of the wall segments 26–32 so as to interconnect the deflector with the grid members surrounding an air vent. Referring to wall segment 26 and tab 34 as examples, each tab preferably extends most of the length of the corresponding wall segment but does not extend to or wrap around the corners. Instead, the tab 34 preferably ends just short of the corners and has tapered ends 42 and 44. The tapered ends 42 and 44 may be at any of several angles, but preferably are at approximately 45 degrees to the outer edge of the tab 34. The ends of the tabs may be spaced from the corners by various amounts, with 1 ½–2 inches being one preferred spacing.

The side members or wall segments may each be said to have a pair of opposed ends, and a mid-portion therebetween. Using wall segment 28 as an example, the wall segment 28 may be said to have a first end 50, an opposed second end 52, and a mid-portion 54 therebetween. The first end of each wall segment may be said to be joined to a second end of an adjacent wall segment so that the wall segments together form a generally rectangular tube or rectangular assembly. The upper edges of the wall segments together define a generally rectangular perimeter. This rectangular perimeter may be said to have a width and a length, with the width and length preferably being approximately equal to the width and length of the opening defined by the grid members. Preferably, the perimeter length and width is approximately equal to or slightly less than the sides of the opening, which is defined herein to be a loose to snug fit in the opening. In some embodiments, the width and length are approximately ¼ to ½ of an inch smaller than the rectangular opening, though they may be in the range of 0 to 1 inch or more smaller than the rectangular opening.

Figure 3:
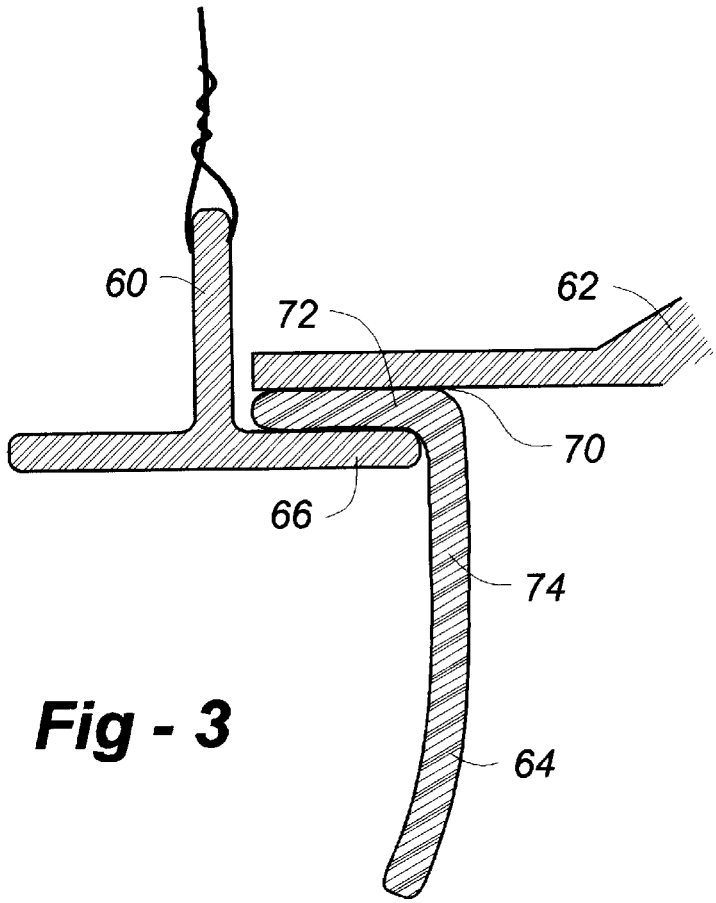
FIG. 3 is a cross-sectional view of a portion of a grid member, an air vent, and an air deflector, according to the present invention.

Referring now to FIG. 3, a cross-sectional view of a ceiling grid 60 is shown supporting a perimeter edge of an air vent 62 and a deflector 64. The grid member 60 may be said to have an upper surface 66 for supporting the air vent. The air vent 62 has a perimeter edge 68 with a lower surface 70, which typically rests on the upper surface 66 of the grid members defining a rectangular opening that receives the air vent 62. According to the present invention, the deflector 64 has an outwardly extending support tab 72 which is positioned between the lower surface 70 of the perimeter edge 68 of the air vent 62 and the upper surface 66 of the grid member 60. In this way, the deflector 64 is retained adjacent to the air vent 62. While in the previous embodiments, the deflector was described as having wall segments that extend directly downwardly from the air vent, the wall segments, such as 74, may flare inwardly or outwardly, or curve inwardly or outwardly, as shown in FIG. 3. Also, the height of the wall segment 74 may vary depending upon the application, with approximately 2 inches being one preferred height.

Figure 4:
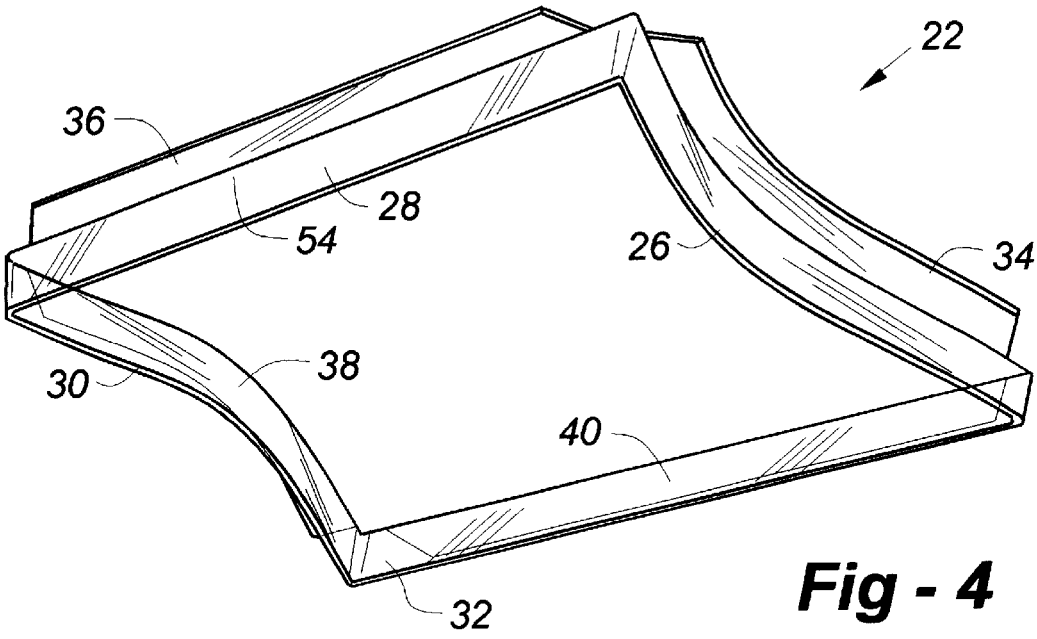
FIG. 4 is a perspective view of the air deflector of FIG. 2, with the deflector being deformed into a non-rectangular shape such that it can be installed on the air vent without disassembly of the air vent or deflector.

The deflector 22 is preferably formed from a plastic that is flexible enough to allow the deflector to be flexed and inserted into a grid once an air vent is already installed, as will be described. Referring now to FIG. 4, the deflector 22 of FIG. 2 is shown flexed such that two of the wall segments 28 and 32 are brought closer to one another while the other two side members 26 and 30, are flexed inwardly, as shown. In this flexed position, the deflector may be installed in the ceiling grid for use with an air vent already installed in the ceiling grid. With the deflector flexed, as shown, the tab 40 extending from segment 32 may be inserted between the lower surface of the air vent and the upper surface of one of the grid members. The flexed deflector may then be pivoted upwardly such that all of the tabs on the other three sides are against the lower face of the air vent. By maintaining the deflector in this position and releasing the flexed wall segments, 26 and 30, such that they straighten out, the tab 36 extending from the segment 28 can be slid between the lower surface of the vent and the upper surface of the grid member. The tabs 34 and 38 on the flexed segments 26 and 30 may also be worked into position between the air vent and the grid members. As will be clear to those of skill in the art, this operation is simple and may be accomplished by an untrained individual without disassembly of the ceiling or removal of the air vent. Once unflexed, the deflector 22 is held in place by the downward pressure of the air vent and by the deflector's natural tendency to remain in the unflexed configuration with the tabs above the grid. The deflector may be also flexed in other ways, such as flexing all four sides or by alternately flexing one side at a time until all tabs are inserted. The tapered ends of the tabs allow the tabs on the flexed sides to clear the corresponding grid members. This is one reason for tapering the ends. The tabs may alternately be shorter to provide clearance. Alternatively, tabs may be provided only on two or three sides. Instead, smaller and/or more numerous tabs may be provided at various locations along the sides of the deflector. As one example, small ½ to 1 inch wide tabs may be provided at a couple locations along each side member. As a further alternative, support tabs may extend from the corners of the deflector body in addition to, or instead of, the tabs extending from the mid-portions of the side wall segments. For example, tabs may extend just from the corners or from the area close to the corners, but not from the mid-portions. The side walls may then be flexed in order to bring the corners inward to allow the tabs to be inserted between the air vent and the grid members. However, it is preferred that support tabs take the form of elongated flanges which serve the dual purpose of retaining the deflector adjacent the air vent and strengthening or stiffening the wall segments once the deflector returns to its undeformed shape.

Preferably, the deflector is unitarily formed from a flexible resilient material such as clear or opaque polyvinyl chloride, or other plastics. As another alternative, the deflector may be cut at one of the corners between two side members such that the cut ends may be overlapped during insertion of the deflector into position. The cut end may then be repositioned into abutment. Alternatively, some kind of interlock may be provided at the cut edges so as to interlock the two pieces when they are reassembled. As yet another alternative, the deflector may be provided as two, three or four separable pieces that abut one another, or interlock, once installed. Other alternatives will also be clear to those of skill in the art. The deflector is preferably injection molded from plastic, such as polyvinyl chloride (PVC) plastic, though other materials and manufacturing approaches may be used. The material may be rigid, or flexible, and clear, opaque, or colored. Preferably, the material is flexible enough to allow the deflector to be flexed for installation, without damage to the deflector, but also resilient enough to retain the deflector in the unflexed configuration once released. In one preferred embodiment, the deflector is formed of clear plastic so that it is less apparent on the ceiling. The deflector may instead be molded in a color to blend in with or complement the ceiling materials. Because the deflector is preferably formed of a plastic or other smooth material, dirt and debris are less likely to accumulate on its surface. The deflector may be easily cleaned of any accumulated dirt or debris by merely wiping it off.

While the present invention has been described for use with a typical square air vent, those of skill in the art will appreciate that the present invention may be used with other sizes and shapes of air vents. For example, some suspended ceilings have long, thin rectangular air vents, sometimes known as air bars. A long, thin version of the present invention may be provided for use with such an air vent. The invention could also be adapted for use with vents with non-rectangular shapes, such as octagon or round.

The present figures and description are directed to preferred embodiments of the present invention. Other alternatives will be clear to those of skill in the art. It is the following claims, including all equivalents, which define the scope of the present invention.

We claim:

1. An air deflector for use with an air vent supported in a suspended ceiling grid, the grid being of the type having a plurality of grid members intersecting so as to form a generally rectangular opening with a predetermined length and a predetermined width, each of the grid members forming the opening having an upper surface for supporting the air vent, the air vent having a generally rectangular perimeter edge with a lower surface that rests on the upper surfaces of the grid members defining the generally rectangular opening, the air deflector comprising:

a deflector body having four side members each having a pair of opposed ends and a midportion therebetween, the ends of each side member being joined to an end of another of the side members such that the four side members form a generally rectangular assembly;

each side member comprising a downwardly extending wall segment having a lower edge and an upper edge, the upper edges of the wall segments together defining a generally rectangular perimeter with a length approximately equal to the predetermined length of the rectangular opening and a width approximately equal to the predetermined width of the rectangular opening;

at least two of the side members further comprising a support tab extending outwardly from the upper edge of the downwardly extending wall segment, the support tabs configured to be received between the upper surfaces of the grid members defining the rectangular opening and the lower surface of the perimeter edge of the air vent such that the deflector body is retained adjacent the rectangular opening;

wherein the deflector body is formed of a resilient material such that the deflector body is deformable into a non-rectangular shape such that the support tabs are positioned between the upper surfaces of the grid members defining the rectangular opening and the lower surface of the perimeter edge of the air vent without disassembling the deflector body or removing the air vent from the rectangular opening.

2. The air deflector according to claim 1, wherein the at least two side members consists of all four side members further comprising a support tab extending outwardly from the upper edge of the downwardly extending wall segment, each support tab being a continuous flange with an end to end length less than the length of the wall segment to which it is joined such that the support tab does not extend to the opposed ends of the side member.

3. The air deflector according to claim 1, wherein the deflector body is unitarily formed of a flexible and resilient material.

4. The air deflector according to claim 3, wherein the flexible and resilient material is a plastic.

5. The air deflector according to claim 1, wherein the generally rectangular perimeter defined by the wall segments is a generally square perimeter.

6. The air deflector according to claim 5, wherein the generally square perimeter has a length and width of approximately 23 inches.

7. The air deflector according to claim 1, wherein the wall segments each taper outwardly such that the lower edges of the wall segments form a generally rectangular perimeter that is larger than the generally rectangular perimeter formed by the upper edges.

8. The air deflector according to claim 1, wherein the wall segments each taper inwardly such that the lower edges of the wail segments form a generally rectangular perimeter that is smaller than the generally rectangular perimeter formed by the upper edges.

9. The air deflector according to claim 1, wherein the wall segments each curve outwardly such that the lower edges of the wall segments form a generally rectangular perimeter that is larger than the generally rectangular perimeter formed by the upper edges.

10. The air deflector according to claim 1, wherein the wall segments each curve inwardly such that the lower edges of the wall segments form a generally rectangular perimeter that is smaller than the generally rectangular perimeter formed by the upper edges.

11. The air deflector according to claim 1, wherein the upper and lower edges of the wall segments are approximately 2 inches apart.

12. An air deflector for use with an air vent supported in a suspended ceiling grid, the grid being of the type having a plurality of grid members intersecting so as to form a generally rectangular opening with a predetermined length and a predetermined width, each of the grid members forming the opening having an upper surface for supporting the air vent, the air vent having a generally rectangular perimeter edge with a lower surface that rests on the upper surfaces of the grid members defining the generally rectangular opening, the air deflector comprising:

a deflector body comprising four downwardly extending wall segments, each wall segment having a first end, an opposed second end, and a midportion therebetween, the first end of each wall segment member being joined to the second end of an adjacent wall segment such that the four wall segments form a generally rectangular tube with an upper end and a lower end, the upper end of the rectangular tube having a rectangular perimeter with a length equal to or slightly smaller than the predetermined length of the rectangular opening and a width equal to or slightly smaller than the predetermined width of the rectangular opening;

the deflector body further comprising a plurality of support tabs extending outwardly from the upper end of the rectangular tube, the support tabs configured to be received between the upper surfaces of the grid members defining the rectangular opening and the lower surface of the perimeter edge of the air vent such that the deflector body is retained adjacent the rectangular opening;

wherein the deflector body is formed of a resilient material such that the deflector body is deformable into a non-rectangular shape such that the support tabs are positioned between the upper surfaces of the grid members defining the rectangular opening and the lower surface of the perimeter edge of the air vent without disassembling the deflector body or removing the air vent from the rectangular opening.

13. The air deflector according to claim 12, wherein the plurality of support tabs comprises four support tabs.

14. The air deflector according to claim 13, wherein the rectangular tube defines four corner regions, the support tabs extending from the midportion of each wall segment and not extending from the corner regions.

15. The air deflector according to claim 14, wherein the support tabs each comprise elongated flanges having a pair of opposed ends, the ends being tapered.

16. The air deflector according to claim 12, wherein the generally rectangular tube is generally square.

17. The air deflector according to claim 16, wherein the generally rectangular perimeter of the generally square tube has a length and width of approximately 23 inches.

18. The air deflector according to claim 12, wherein the generally rectangular tube has a height of approximately 2 inches.

19. The air deflector according to claim 12, wherein the deflector body is unitarily formed of a flexible and resilient material.

20. A method for providing an air deflector adjacent an air vent, the method comprising the steps of:

providing a suspended ceiling grid with an air vent supported therein, the ceiling grid comprising a plurality of grid members intersecting so as to form a generally rectangular opening with a predetermined length and a predetermined width, each of the grid members forming the opening having an upper surface for supporting the air vent, the air vent having a generally rectangular perimeter edge with a lower surface, the lower surface being supported on the upper surfaces of the grid members defining the generally rectangular opening;

providing an air deflector, the air deflector comprising a deflector body having four downwardly extending wall segments, each wall segment having a first end, and opposed second end, and a midportion therebetween, the first end of each wall segment member being joined to the second end of an adjacent wall segment such that the four wall segments form a generally rectangular tube with an upper end and a lower end, the upper end of the rectangular cube having a rectangular perimeter with a length equal to or slightly smaller than the predetermined length of the rectangular opening and a width equal to or slightly smaller than the predetermined width of the rectangular opening, the deflector body further comprising a plurality of support tabs extending outwardly from the upper end of the rectangular tube;

deforming the deflector body into a non-rectangular shape; and pushing the support tabs between the upper surfaces of the grid members defining the rectangular opening and the lower surface of the perimeter edge of the air vent such that the deflector body is retained adjacent the rectangular opening;

wherein the support tabs are positioned between the upper surfaces of the grid members defining the rectangular opening and the lower surface of the perimeter edge of the air vent without disassembling the deflector body or removing the air vent from the rectangular opening.

* * * * *

UNITED STATES PATENT AND TRADEMARK OFFICE

CERTIFICATE OF CORRECTION

PATENT NO. : 6,745,518 B2 
DATED : June 8, 2004
INVENTOR(S) : Jeffrey L. Weakes and Edward S. Jacobs It is certified that error appears in the above-identified patent and that said Letters Patent is hereby corrected as shown below:

Column 7,
Line 11, replace “wail” with -- wall --.

Column 8,
Line 43, replace “cube” with -- tube --.

Signed and Sealed this

Fifteenth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,745,518 B2 
DATED : June 8, 2004
INVENTOR(S) : Jeffrey L. Weaks and Edward S. Jacobs It is certified that error appears in the above-identified patent and that said Letters Patent is hereby corrected as shown below:

Title page,
Item [75], Inventors, delete "Weakes" and insert -- Weaks --

Signed and Sealed this

Ninth Day of August, 2005

JON W. DUDAS
*Director of the United States Patent and Trademark Office*